US007328513B1

(12) United States Patent
Yang

(10) Patent No.: US 7,328,513 B1
(45) Date of Patent: Feb. 12, 2008

(54) CUTTER HAVING CHANGEABLE CARRIER

(76) Inventor: Chung Cheng Yang, No. 33, Lane 60, Guanjen Road, Dali City, Taichung Hsien (TW) 41278

( * ) Notice: Subject to any disclaimer, the term of this patent is extended or adjusted under 35 U.S.C. 154(b) by 108 days.

(21) Appl. No.: 11/344,672

(22) Filed: Jan. 31, 2006

(51) Int. Cl.
*B26B 17/02* (2006.01)

(52) U.S. Cl. ..... 30/178; 30/92; 30/179; 30/190; 30/233; 30/251

(58) Field of Classification Search ..... 30/178, 30/179, 229, 233, 251, 289, 290, 92, 190
See application file for complete search history.

(56) References Cited

U.S. PATENT DOCUMENTS 5,469,625 A * 11/1995 Melter et al. ..... 30/251
5,511,314 A * 4/1996 Huang ..... 30/251
5,913,575 A 6/1999 Lai ..... 30/229
6,308,421 B1 * 10/2001 Wang ..... 30/178
6,757,978 B1 * 7/2004 Huang ..... 30/178
2005/0198833 A1 * 9/2005 Lin ..... 30/131

* cited by examiner

*Primary Examiner*—Hwei-Siu C. Payer
(74) *Attorney, Agent, or Firm*—Charles E. Baxley

(57) ABSTRACT

A cutter includes a lever having a handle on one end and a fixed jaw on the other end and having one or more catches extended from the fixed jaw and having a groove formed in the fixed jaw, a cutter device is pivotally attached to the lever and has a cutter blade movable toward and away from the fixed jaw, a hand grip is pivotally coupled to lever and coupled to move the cutter device toward and away from the fixed jaw. One or more carriers each includes one end engageable with the catch of the lever, and a fin for engaging into the groove of the fixed jaw and for quickly anchoring and positioning the carrier to the fixed jaw of the lever without fasteners.

9 Claims, 11 Drawing Sheets

CUTTER HAVING CHANGEABLE CARRIER

BACKGROUND OF THE INVENTION

1. Field of the Invention

The present invention relates to a cutter, and more particularly to a cutter having one or more easily and readily changeable carriers for easily and quickly attaching and detaching from a fixed jaw of a lever without threading or unthreading any fasteners and for allowing the carriers to be quickly attached to the fixed jaw of the lever.

2. Description of the Prior Art

Typical cutters, particularly pipe cutters comprise a pair of levers pivotally coupled together, in which one of the levers includes a cutter blade, and the other lever includes a fixed jaw having a bracket or having a mold piece for stably retaining strips or pipes to be cut, and for allowing the strips or pipes to be effectively cut by the cutter blade.

For example, U.S. Pat. No. 5,913,575 to Lai discloses one of the typical pipe cutters comprising a bracket detachably attached or secured to the fixed jaw of the pipe cutter and having a mold piece for stably retaining strips or pipes to be cut, and a cutter blade attached to the other lever for being moved toward the mold piece of the bracket in order to cut the strips or pipes.

However, it takes a long time to thread and to secure the bracket to the fixed jaw of the pipe cutter with one or more fasteners, and it is also time consuming to disengage the fasteners from the bracket and the fixed jaw of the pipe cutter, such that it is inconvenient to attach and to detach the bracket from the fixed jaw of the pipe cutter.

The present invention has arisen to mitigate and/or obviate the afore-described disadvantages of the conventional pipe supporting brackets for the pipe cutters.

SUMMARY OF THE INVENTION

The primary objective of the present invention is to provide a cutter including one or more carriers for easily and readily changed and attached and detached from a fixed jaw of the cutter without threading and unthreading fasteners.

In accordance with one aspect of the invention, there is provided a cutter comprising a lever including a handle provided on one end and a fixed jaw provided on the other end, and including a middle portion, and including at least one catch extended from the fixed jaw and located close to the middle portion of the lever, and including a groove formed in the fixed jaw, a cutter device pivotally attached to the lever with a pivot axle, and including a cutter blade movable toward and away from the fixed jaw of the lever, and including a rear portion, a hand grip pivotally coupled to the middle portion of the lever and movable toward and away from the handle of the lever and coupled to the cutter device for moving the cutter blade toward and away from the fixed jaw of the lever, and at least one carrier including a first end engageable with the catch of the lever, and including a downwardly extended fin for engaging into the groove of the fixed jaw and for anchoring and positioning the carrier to the fixed jaw of the lever, the carrier being provided for supporting a work piece to be cut and may be easily and readily changed and attached and detached from the fixed jaw of the cutter without threading and unthreading any fasteners such that the carrier may be quickly changed from each other.

The lever includes a recess formed in the fixed jaw and located close to a free end portion of the fixed jaw and communicating with the groove of the fixed jaw, and at least one carrier includes at least one anchoring member extended from the fin and engageable into the recess of the fixed jaw for anchoring the carrier to the fixed jaw of the lever.

The lever includes at least one projection extended from the fixed jaw and extended into the recess of the fixed jaw for engaging with the anchoring members and for anchoring the fin of the carrier to the fixed jaw of the lever.

The lever includes at least one protrusion extended therefrom and engageable into the recess of the fixed jaw for anchoring the carrier to the fixed jaw of the lever. The carrier includes one or more notches formed therein for receiving the various work pieces to be cut.

The carrier includes a slit aligned with the cutter blade for receiving the cutter blade. The cutter device includes a channel formed in the rear portion of the cutter device, and a link includes a first end pivotally coupled to the hand grip, and a peg is attached to a second end and slidably engaged in the channel of the cutter device.

The cutter device includes at least one depression formed in the rear portion of the cutter device for selectively receiving the peg and for adjustably coupling the hand grip to the cutter device. The hand grip includes a slidable lock device for selectively engaging with the rear portion of the cutter device in order to lock the cutter blade and the fixed jaw together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
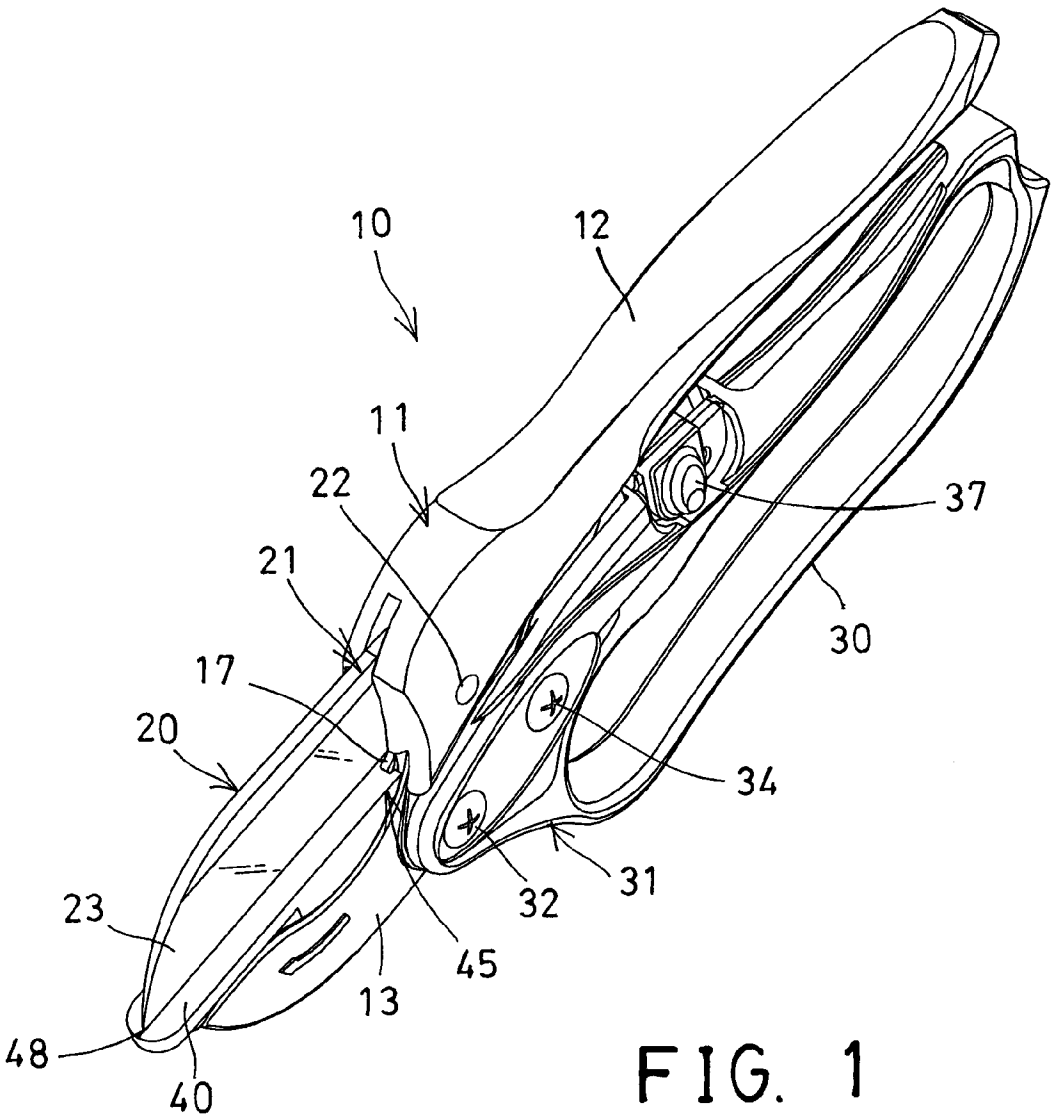
FIG. 1 is a perspective view of a cutter in accordance with the present invention.
Figure 2:
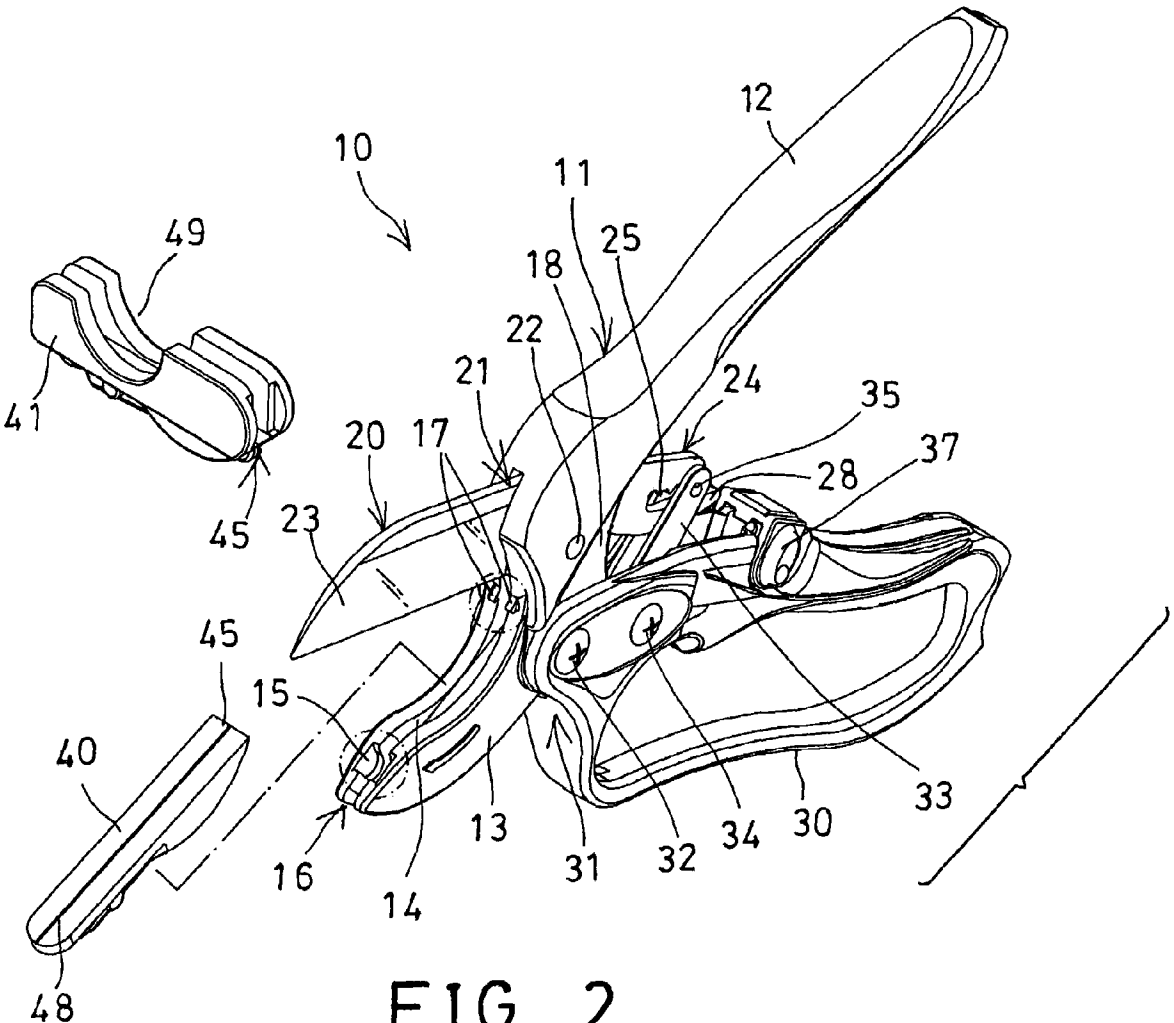
FIG. 2 is a partial exploded view of the cutter.
Figure 5:
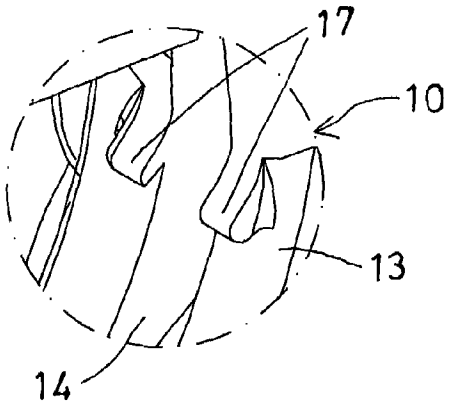
FIGS. 4 and 5 are enlarged partial perspective views of the cutter.
Figure 3:
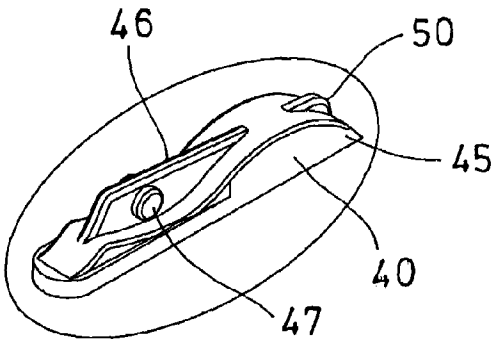
FIG. 3 is a bottom perspective view illustrating a carrier of the cutter.
Figure 4:
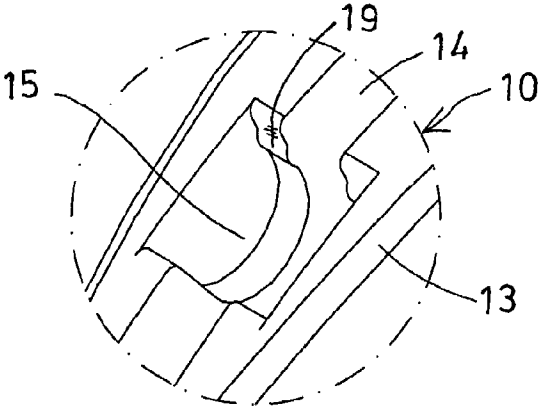
Figure 6:
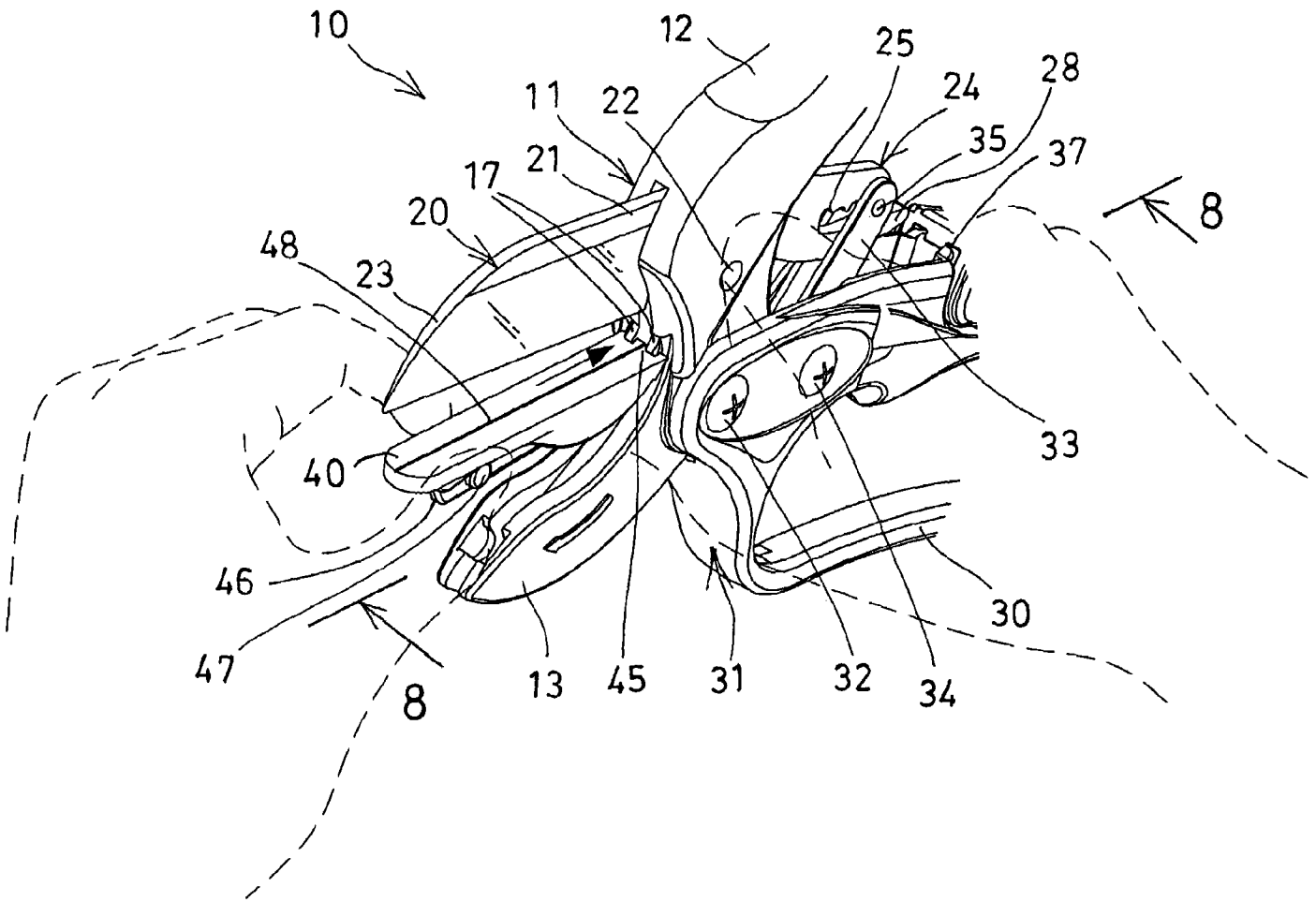
FIGS. 6 and 7 are partial perspective views illustrating the operation of the cutter.
Figure 7:
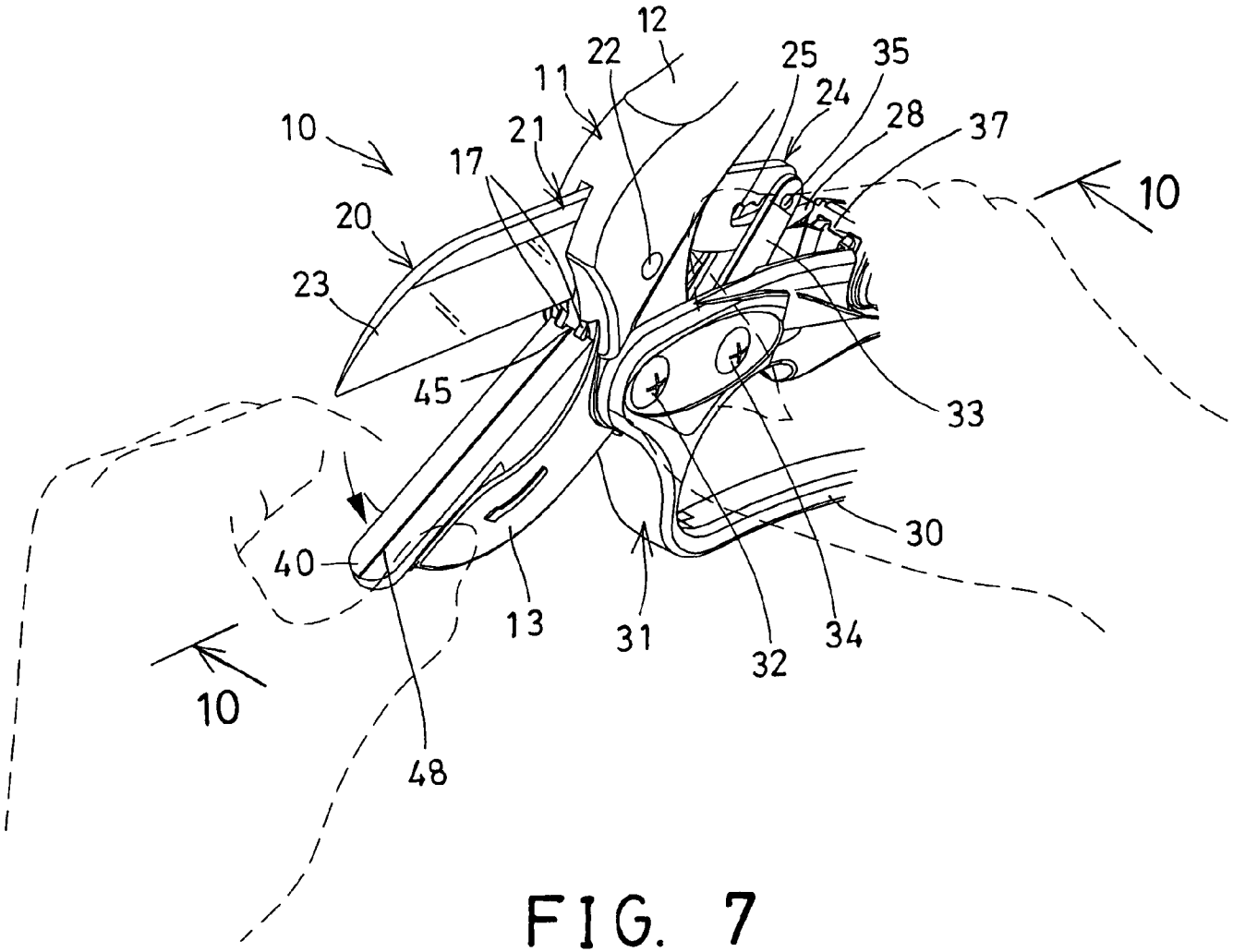
Figure 9:
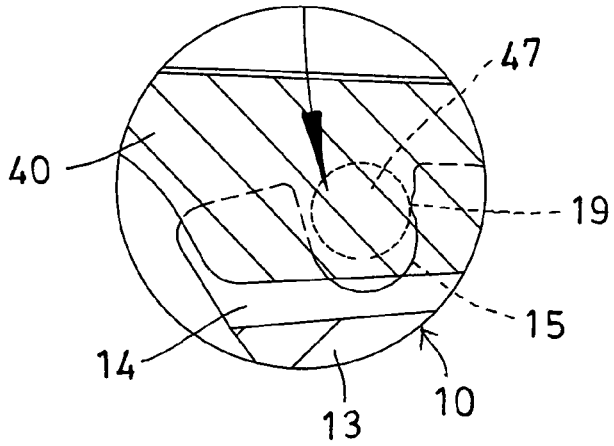
FIG. 9 is an enlarged partial cross sectional view of the cutter as shown in FIG. 8.
Figure 8:
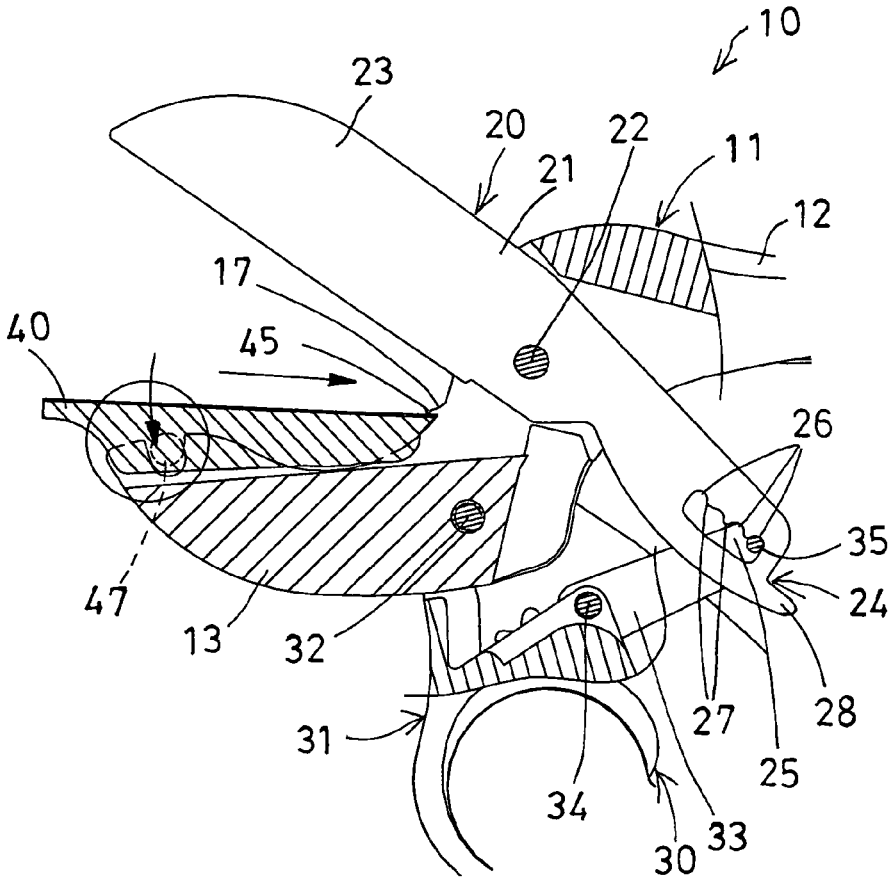
FIG. 8 is a partial cross sectional view of the cutter taken along lines 8-8 of FIG. 6.
Figure 11:
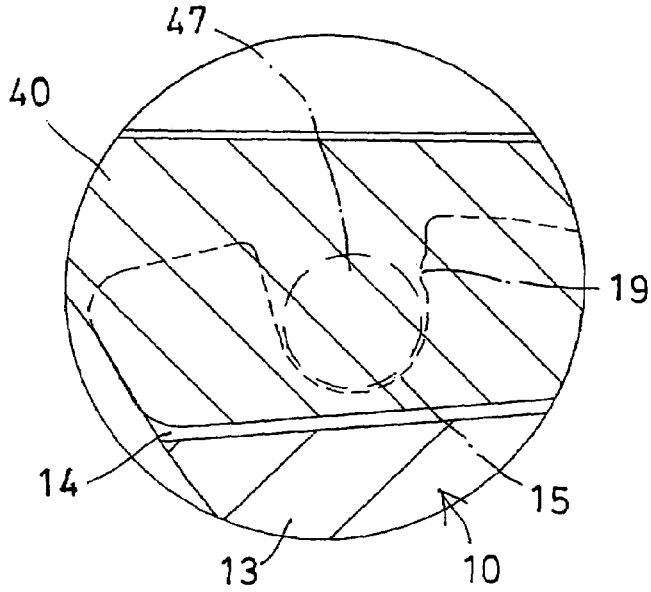
FIG. 11 is an enlarged partial cross sectional view of the cutter as shown in FIG. 10.
Figure 10:
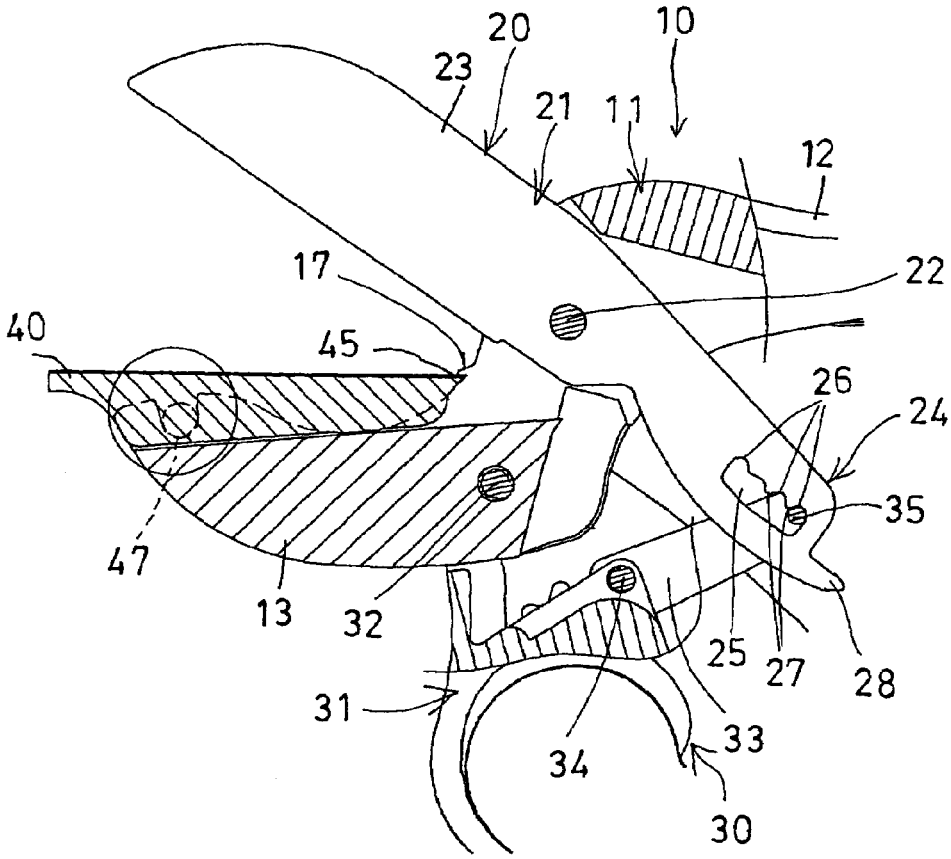
FIG. 10 is a partial cross sectional view of the cutter taken along lines 10-10 of FIG. 7.
Figure 12:
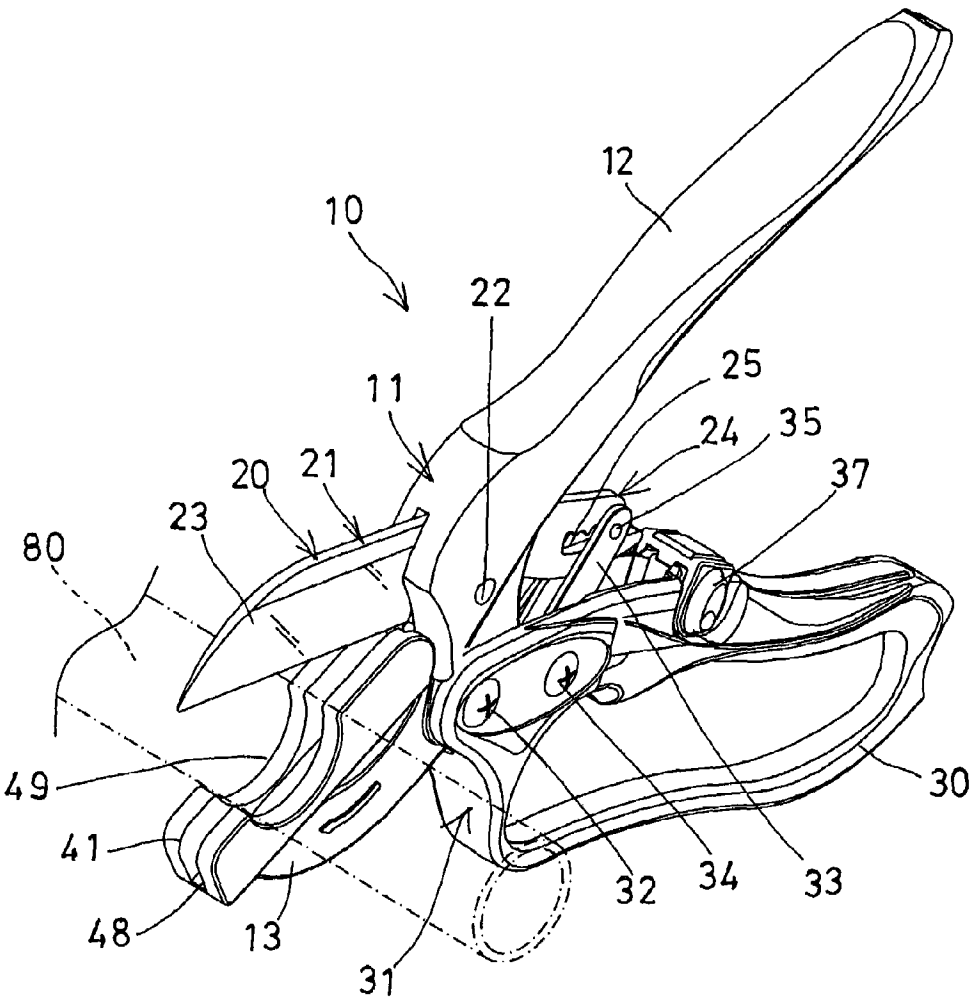
FIG. 12 is a perspective view illustrating another carrier changeably attached to the cutter.
Figure 13:
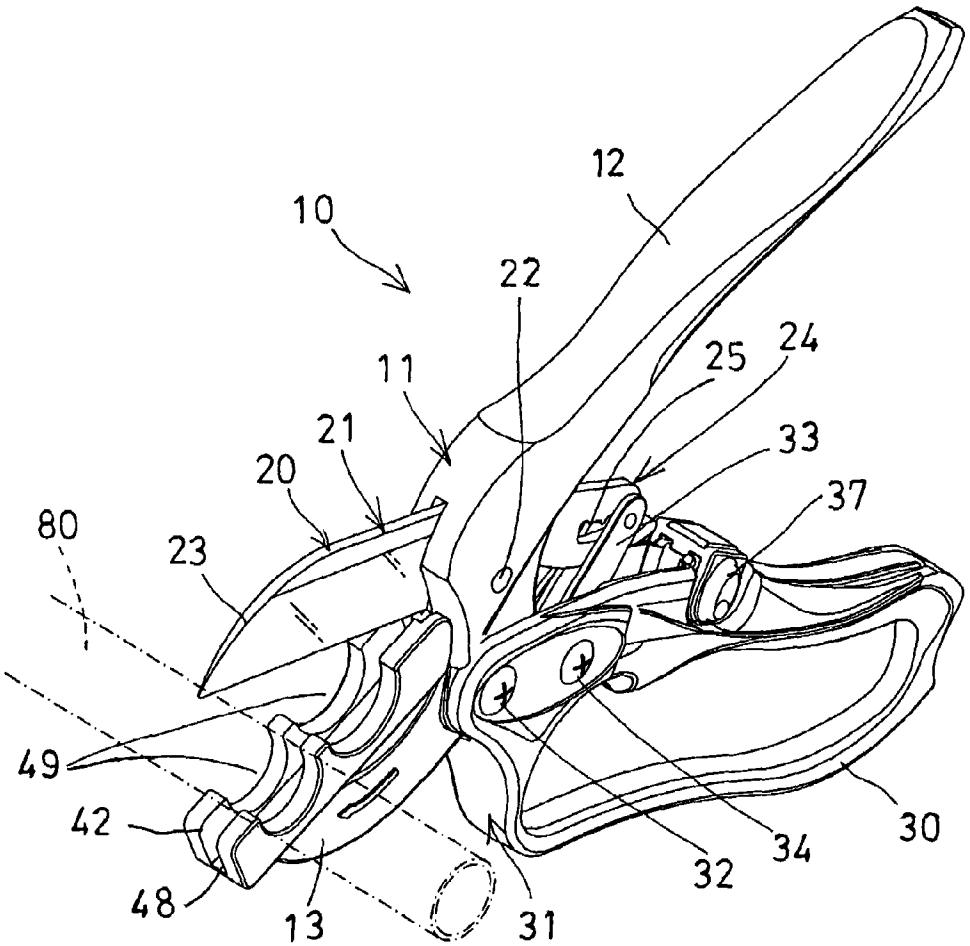
FIGS. 13, 14, 15 are perspective views similar to FIG. 12, illustrating the operation of the cutter.
Figure 14:
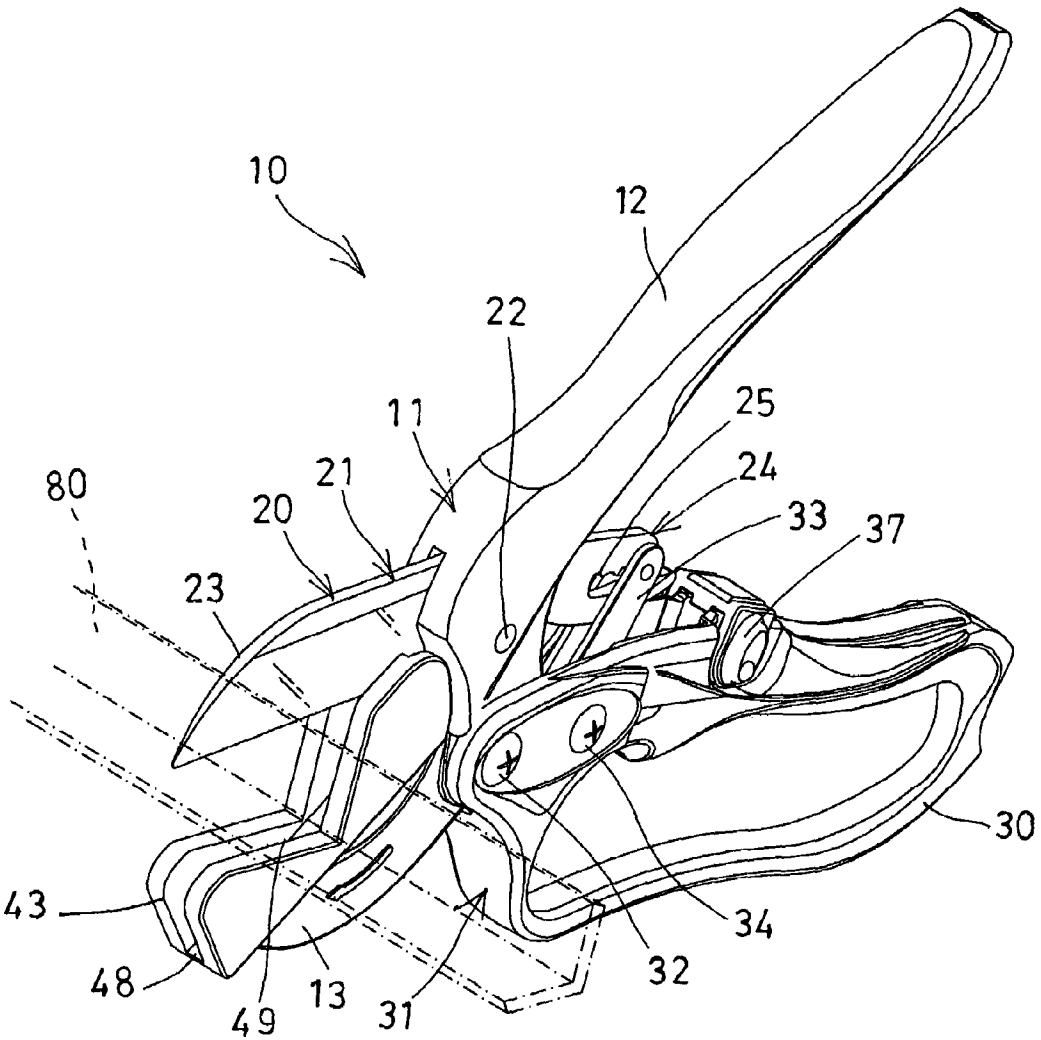
Figure 15:
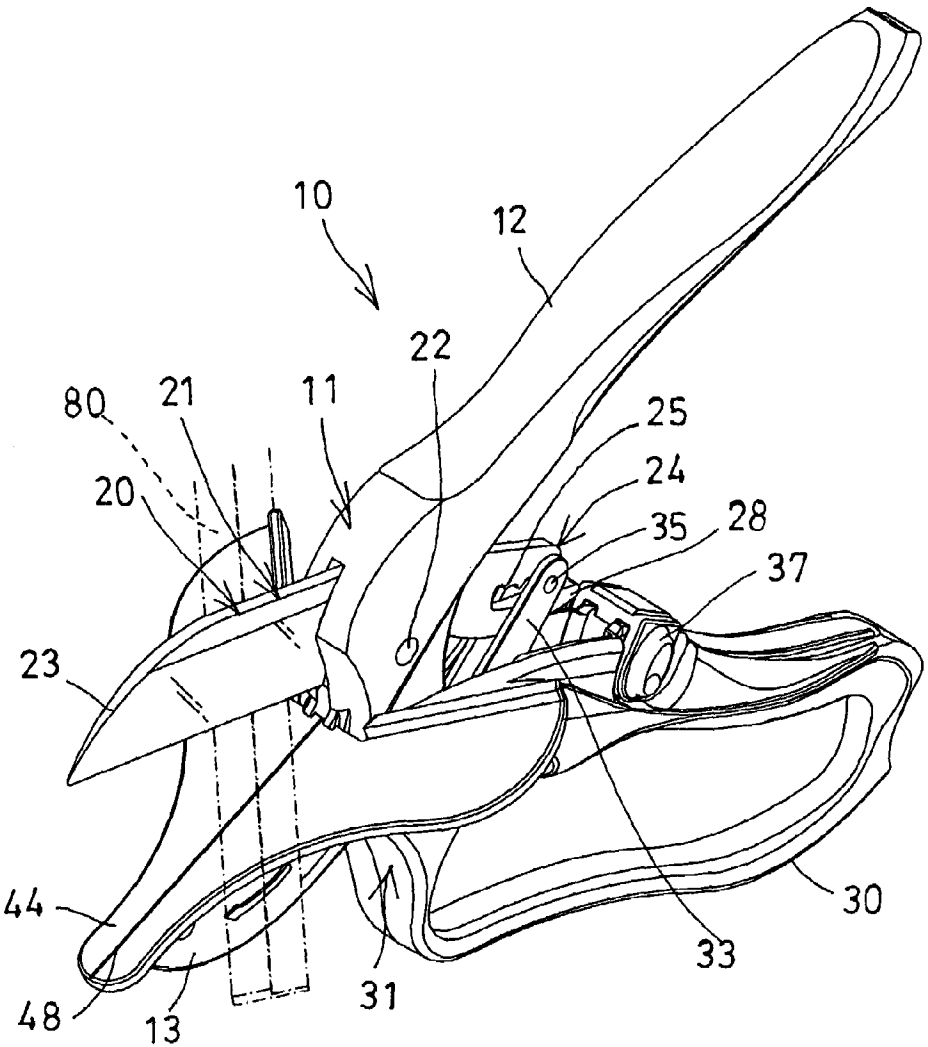

Referring to the drawings, and initially to FIGS. 1-8, a cutter 10 in accordance with the present invention comprises a lever 11 including a handle 12 formed or provided on one end or rear end thereof, and including a fixed jaw 13 formed or provided on the other end or front end thereof, and including a groove 14 formed in the fixed jaw 13 and preferably facing upwardly, best shown in FIGS. 2 and 4-5, and further including a recess 15 formed in the fixed jaw 13 and located close to the free end portion 16 of the fixed jaw 13 and intersecting or communicating with the groove 14 of the fixed jaw 13 (FIGS. 2, 4).

The lever 11 further includes one or more, such as two catches 17 extended from the fixed jaw 13 and located close to the middle portion 18 of the lever 11 and preferably disposed beside the groove 14 of the fixed jaw 13, best shown in FIGS. 2 and 5. The lever 11 further includes one or more, such as two projections 19 extended from the fixed jaw 13 and extended into the recess 15 of the fixed jaw 13 (FIG. 4) for anchoring purposes. It is preferable that the groove 14 is also formed through the middle portion 18 of the lever 11 for movably or rotatably receiving a cutter device 20 therein.

The cutter device 20 includes a middle portion 21 engaged into or through the groove 14 or the middle portion 18 of the lever 11 and rotatably or pivotally coupled to the fixed jaw 13 or the middle portion 18 of the lever 11 with a pivot axle 22, and includes a cutter blade 23 formed or provided on the front portion thereof and rotatable or movable toward and away from the fixed jaw 13 of the lever 11, and includes a rear portion 24 having a channel 25 formed therein (FIG. 8), and includes one or more depressions 26 formed in the rear portion 24 thereof and defined by one or more swellings 27 and preferably communicating with the channel 25 of the cutter device 20.

A hand grip 30 includes one end or front end 31 rotatably or pivotally coupled to the middle portion 18 of the lever 11 with a pivot shaft 32 for allowing the hand grip 30 to be rotated or moved toward and away from the handle 12 of the lever 11 by the user. A link 33 includes one end rotatably or pivotally coupled to the hand grip 30 with a pivot pin 34 and a peg 35 attached to the other end thereof for slidably engaging in the channel 25 of the cutter device 20 and for selectively engaging into either of the depressions 26 of the cutter device 20, and thus for adjustably coupling the hand grip 30 to the cutter device 20, and thus for allowing the cutter device 20 to be moved toward and away from the fixed jaw 13 by the hand grip 30.

It is preferable that the cutter device 20 further includes a tongue 28 extended rearwardly therefrom (FIGS. 8, 10), and a lock device 37 is further provided and slidably attached onto the middle portion of the hand grip 30 and movable toward and away from the tongue 28 of the cutter device 20 for selectively engaging onto the tongue 28 of the cutter device 20 in order to selectively lock the cutter blade 23 and the fixed jaw 13 together (FIG. 1), or for selectively disengaging from the tongue 28 of the cutter device 20 in order to selectively release the cutter blade 23 from the fixed jaw 13 (FIGS. 6-8, 10 and 12-15).

As shown in FIGS. 1-3 and 12-15, the cutter 10 further includes one or more carriers 40, 41, 42, 43, 44 to be selectively or changeably attached to the fixed jaw 13 of the lever 11, and each of the carriers 40-44 includes a front end or one end portion 45 engageable with the catches 17 of the lever 11, and includes a fin 46 extended downwardly therefrom (FIG. 3) for engaging into the groove 14 of the fixed jaw 13 and for anchoring or securing or positioning the carriers 40-44 to the fixed jaw 13 of the lever 11, and for preventing the carriers 40-44 from being disengaged from the fixed jaw 13 of the lever 11.

It is preferable that the carriers 40-44 each further includes one or more anchoring members 47 extended from the fin 46 and engageable into the recess 15 of the fixed jaw 13 (FIGS. 8-11) for further anchoring or securing or positioning the carriers 40-44 to the fixed jaw 13 of the lever 11. The projections 19 of the fixed jaw 13 of the lever 11 may further be engaged with the anchoring members 47 for further stably anchoring or securing or positioning the carriers 40-44 to the fixed jaw 13 of the lever 11. It is further preferable that the carriers 40-44 each further includes one or more protrusions 50 extended therefrom (FIG. 3) and engageable into the recess 15 of the fixed jaw 13 for further stably anchoring or securing or positioning the carriers 40-44 to the fixed jaw 13 of the lever 11.

It is further preferable that the carriers 40-44 each further includes a slit 48 formed in the upper portion thereof and aligned with the cutter blade 23 for receiving the cutter blade 23 (FIG. 1), and includes one or more notches 49 formed therein (FIGS. 2 and 12-14) for receiving the strips or pipes or work pieces 80 to be cut. It is to be noted that the carriers 40-44 may be easily and readily changed and attached and detached from the fixed jaw of the cutter without threading and unthreading any fasteners such that the carriers 40-44 may be quickly changed from each other.

Accordingly, the cutter in accordance with the present invention includes one or more carriers for easily and readily changed and attached and detached from a fixed jaw of the cutter without threading and unthreading fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cutter comprising:

a lever including a handle provided on one end thereof and a fixed jaw provided on the other end thereof, and including a middle portion, and including at least one catch extended from said fixed jaw and located close to said middle portion of said lever, and including a groove formed in said fixed jaw, a cutter device pivotally attached to said lever with a pivot axle, and including a cutter blade movable toward and away from said fixed jaw of said lever, and including a rear portion, a hand grip pivotally coupled to said middle portion of said lever and movable toward and away from said handle of said lever and coupled to said cutter device for moving said cutter blade toward and away from said fixed jaw of said lever, and at least one carrier including a first end engageable with said at least one catch of said lever, and including a downwardly extended fin for engaging into said groove of said fixed jaw and for anchoring and positioning said at least one carrier to said fixed jaw of said lever, said at least one carrier being provided for supporting a work piece to be cut.

2. The cutter as claimed in claim 1, wherein said lever includes a recess formed in said fixed jaw and located close to a free end portion of said fixed jaw and communicating with said groove of said fixed jaw, and said at least one carrier includes at least one anchoring member extended from said fin and engageable into said recess of said fixed jaw for anchoring said at least one carrier to said fixed jaw of said lever.

3. The cutter as claimed in claim 2, wherein said lever includes at least one projection extended from said fixed jaw and extended into said recess of said fixed jaw for engaging with said at least one anchoring member and for anchoring said fin of said at least one carrier to said fixed jaw of said lever.

4. The cutter as claimed in claim 1, wherein said at least one carrier includes at least one protrusion extended therefrom and engageable into said recess of said fixed jaw for anchoring said at least one carrier to said fixed jaw of said lever.

5. The cutter as claimed in claim 1, wherein said at least one carrier includes at least one notch formed therein for receiving the work piece to be cut.

6. The cutter as claimed in claim 1, wherein said at least one carrier includes a slit aligned with said cutter blade for receiving said cutter blade.

7. The cutter as claimed in claim 1, wherein said cutter device includes a channel formed in said rear portion of said cutter device, and a link includes a first end pivotally coupled to said hand grip, and a peg attached to a second end and slidably engaged in said channel of said cutter device.

8. The cutter as claimed in claim 7, wherein said cutter device includes at least one depression formed in said rear portion of said cutter device for selectively receiving said peg.

9. The cutter as claimed in claim 1, wherein said hand grip includes a slidable lock device for selectively engaging with said rear portion of said cutter device in order to lock said cutter blade and said fixed jaw together.

* * * * *